United States Patent [19]

Doerner

[11] Patent Number: 4,534,533

[45] Date of Patent: Aug. 13, 1985

[54] COVER FOR CHAIR LEG

[76] Inventor: Frank Doerner, 138 Aberdeen Rd., Kitchener, Ontario, Canada, N2M 2Y7

[21] Appl. No.: 542,401

[22] Filed: Oct. 17, 1983

[30] Foreign Application Priority Data

Mar. 15, 1983 [CA] Canada ..... 423610

[51] Int. Cl.[3] ..... A47B 95/00

[52] U.S. Cl. ..... 248/345.1

[58] Field of Search ..... 248/345.1, 188.7, 188.8; 297/349, 411; 52/821, 822

[56] References Cited

U.S. PATENT DOCUMENTS

| | | | |
|---|---|---|---|
| 1,804,841 | 5/1931 | Pedroli | 248/345.1 |
| 2,603,909 | 7/1952 | Pettibone | 248/345.1 |
| 3,160,382 | 12/1964 | Lee | 248/188.7 |
| 3,289,995 | 12/1966 | Taylor | 248/345.1 |
| 3,634,925 | 1/1972 | Van Loo | 248/345.1 |
| 3,643,905 | 2/1972 | Kint | 248/345.1 |
| 3,705,704 | 12/1972 | Textoris | 248/345.1 |
| 3,994,466 | 11/1976 | Troup | 248/345.1 |
| 4,089,497 | 5/1978 | Miller et al. | 248/345.1 |
| 4,262,871 | 4/1981 | Kolk et al. | 248/345.1 |

FOREIGN PATENT DOCUMENTS

| | | | |
|---|---|---|---|
| 0017495 | 10/1980 | European Pat. Off. | 248/188.7 |
| 1575105 | 11/1969 | Fed. Rep. of Germany | 248/345.1 |
| 0480826 | 12/1969 | Switzerland | 211/105.1 |

*Primary Examiner*—William H. Schultz
*Assistant Examiner*—Ramon O. Ramirez
*Attorney, Agent, or Firm*—Riches, McKenzie & Herbert

[57] ABSTRACT

This invention discloses a novel cover for use with legs of a chair base, particularly for use with chairs having a plurality of legs extending radially outwardly from a central column. The cover is adapted to surround and cover one leg and comprises a cover portion, a first end portion to cover the end of the leg, spacing means to space the cover portion from the top surface of the leg, and retaining means to releasably retain the cover to the leg. A retaining ring is also provided and adapted to retain the second ends of all of the covers in the desired position. Securing means may also be provided to secure the cover to the leg to prevent longitudinal movement once the cover is in place. The use of the cover allows the user to select the desired look of any shape and color and also protects the chair legs and prevents damage thereof. The use of the cover has reduced the cost of manufacturing a chair since, with the cover, the legs may be unfinished and need not be replaced over the life of the chair.

38 Claims, 18 Drawing Figures

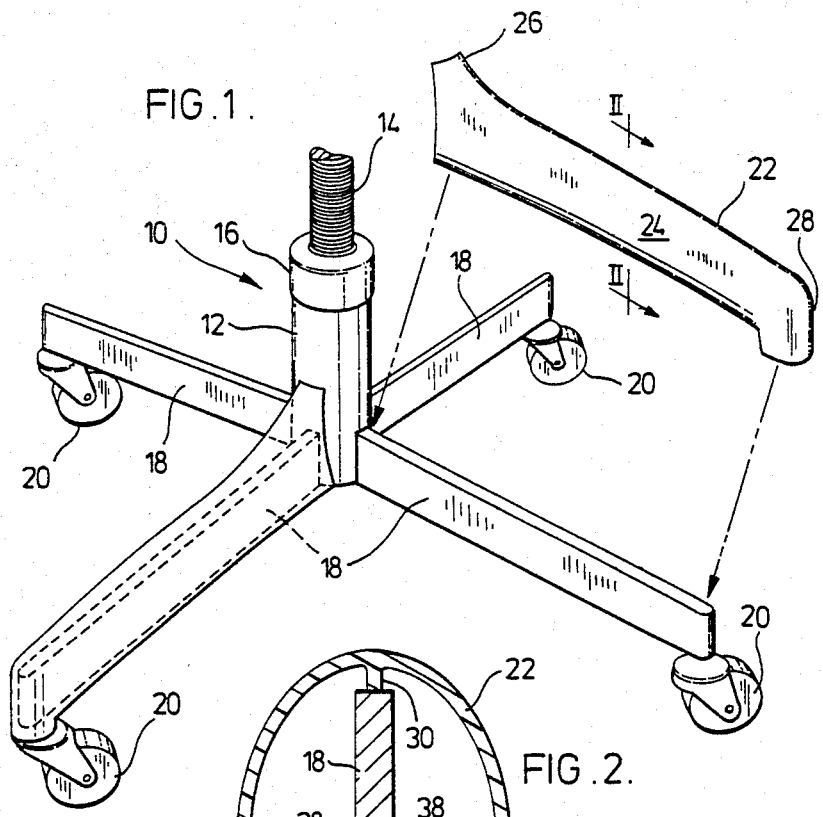
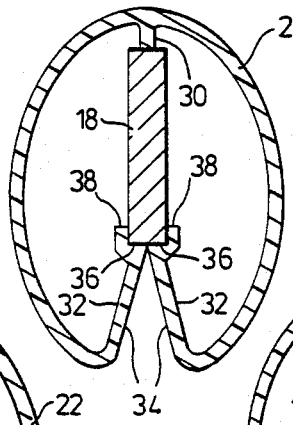
FIG. 2.
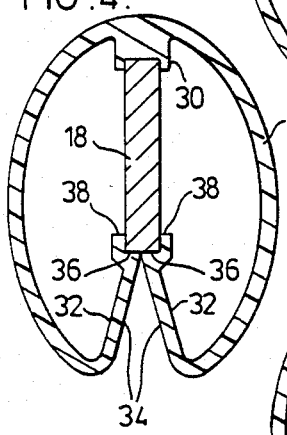
FIG. 4.
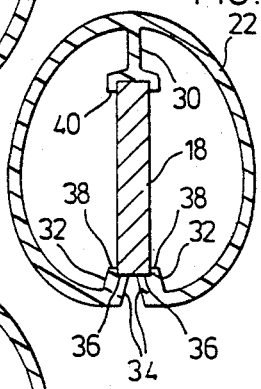
FIG. 3.
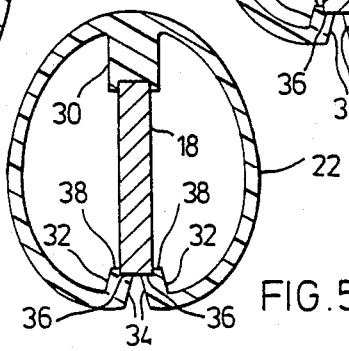
FIG. 5.

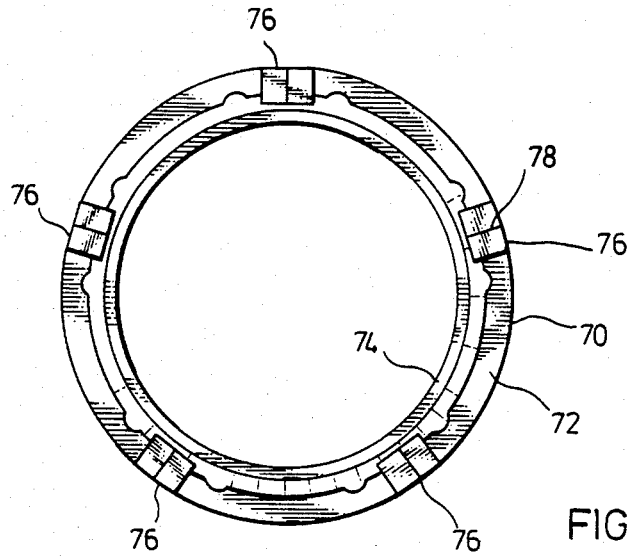
FIG. 17.
FIG. 18.
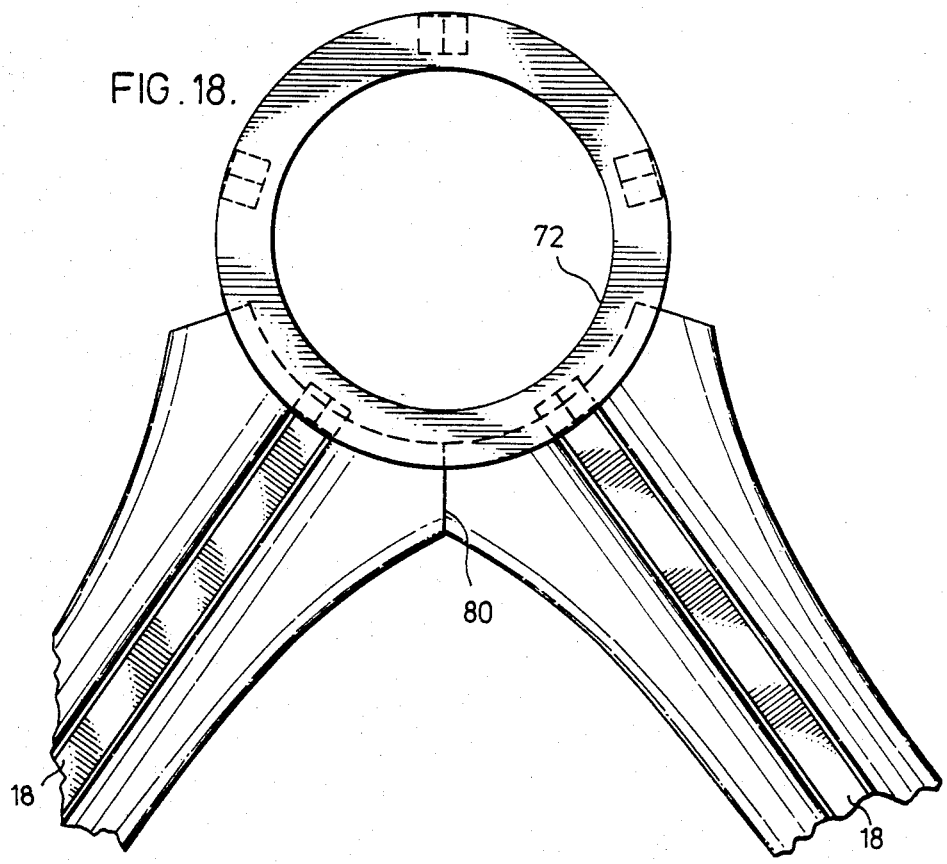

COVER FOR CHAIR LEG

BACKGROUND OF THE INVENTION

1. Field of the Invention

This invention relates generally to chairs and more particularly, to a novel cover for the legs of a chair base.

2. Description of the Prior Art

In the past, chairs have been manufactured with a variety of configurations of legs which rest on the floor and which support the chair seat either directly or indirectly. The present invention is directed to chairs most commonly found in offices which utilize a central spindle or column which depends from a chair seat or a chair control and which has a plurality of radially-extending legs from the central spindle or column. In most cases, casters are secured to the ends of the legs to permit easy movement of the chair.

However, it is to be understood that while the present invention will be described for use with the type of chair described hereinbefore, it may find applicability for any chair.

The chair legs may be made of any suitable material such as steel, wood or the like. The shape and configuration of these legs as well as the material from which they are constructed, are chosen to complement the desired look of the entire chair. One of the problems associated with these chair legs is that they become damages or "worn" after a period of time. This may be due to a number of reasons but in most cases, by the user of the chair resting his or her feet or shoes directly on the leg.

A second problem associated with these chair legs is that they do become damaged by striking such objects as desks. These chairs generally are mobile and are moved around by the user and will contact other articles of furniture.

These chair legs also represented a significant cost of manufacture. They must be finished to an aesthetically-acceptable degree in the desired material and cannot be interchanged with other chair legs. Thus, each set of legs must be manufactured to meet the desired specifications of the chair itself.

Several attempts have been made in the prior art to overcome these difficulties although each attempt suffers from significant drawbacks.

One such attempt included the provision of a plate along the top surface of the chair leg. This plate was designed to protect the leg from damage caused by the user's foot or shoe and did so successfully but represented an increased cost of manufacture.

More recently, chair legs have been manufactured and then covered by a coating of urethane to protect the leg itself. This procedure aided in the prevention of damage to the chair leg but also represented a significant increase in the cost of manufacture. Also, each chair leg must be individually coated to specification.

SUMMARY OF THE INVENTION

Accordingly, it is an object of the present invention to at least partially overcome these disadvantages by providing a novel cover for a chair leg which may be manufactured separately from the chair leg and which is suitable for use with a variety of chair legs.

It is a further object of this invention to provide a novel cover for a chair leg which protects the chair leg from damage during use.

It is a further object to provide a novel cover for a chair leg which will cover and provide an aesthetically pleasing appearance to the chair leg.

A still further object of this invention is to provide a novel cover for a chair leg which may be easily affixed to the chair leg without the use of any tools.

It is an object of this invention to provide a chair leg cover which may be manufactured of any colour and which is completely interchangeable.

To this end, in one of its aspects, the invention provides a cover adapted to cover a leg of a chair, said cover comprising a cover portion adapted to surround and cover said leg a first end portion adapted to cover the end of the leg, spacing means adapted to space said cover portion from the top surface of said leg, and retaining means adapted to releasably retain said cover to said leg.

In another of its aspects, the invention provides a plastic cover adapted to cover a leg of a chair, said leg extending outwardly from a central column and terminating in a free end, said cover comprising:

a cover portion adapted to sorround and cover said leg;

a first end portion adapted to cover the free end of said leg and to extend marginally below the free end of said leg;

a second end portion adapted to mate with said central column, a longitudinal protrusion protruding inwardly from the top inner surface of said cover and adapted to seat on the top surface of said leg thereby spacing said cover portion from the top surface of said leg; and retaining means adapted to releasably retain and cover to said leg, said retaining means comprising a pair of upturned and inwardly biased flanges adapted to be releasably secured to the lower surfaces of said leg, said flanges carrying a seat portion which is adapted to receive and retain the bottom of said leg therein.

In yet another of its aspects, the invention provides a covering means adapted to cover and be retained on a leg of a chair, said covering means comprising a cover portion adapted to surround and cover said leg, a first end portion adapted to cover the end of the leg, spacing means adapted to space said cover portion from the top surface of said leg, and retaining means adapted to releasably retain said cover to said leg, and a retaining ring adapted to retain the second ends of a plurality of covering means covers in the desired position.

In still another of its aspects, the invention provides a covering means adapted to cover a leg of a chair, said leg extending outwardly from a central column and terminating in a free end, said covering means comprises:

a plastic cover portion adapted to surround and cover said leg;

a first end portion adapted to cover the free end of said leg and to extend merginally below the free end of said leg;

a second end portion adapted to mate with said central column;

a longitudinal protrusion protruding inwardly from the top inner surface of said cover and adapted to seat on the top surface of said leg thereby spacing said cover portion from the top surface of said leg; and retaining means adapted to releasably retain said cover to said leg, said retaining means comprising a pair of upturned and inwardly biased flanges adapted to be releasably secured to the lower surfaces of said leg, said flanges carrying a seat portion which is adapted to receive and retain the bottom of said leg therein, and a retaining ring adapted to retain the second ends of a plurality of covers in the desired position.

Further objects and advantages of the invention will appear from the following description of taken together with the accompanying drawings.

BRIEF DESCRIPTION OF THE DRAWINGS

FIG. 1 is a prespective view of a chair base showing one leg with the cover affixed thereto and an exploded view of an assembled leg and cover.

FIG. 2 is a sectional view along line II—II of FIG. 1 showing one embodiment of the spacing means and the retaining means of the present invention.

FIG. 3 is a sectional view along line II—II of FIG. 1 and showing a second embodiment of the spacing means and the retaining means of the invention.

FIG. 4 is a sectional view along line II—II of FIG. 1 and showing a third embodiment of the spacing means and the retaining means of the invention.

FIG. 5 is a sectional view along line II—II of FIG. 1 and showing a fourth embodiment of the spacing means and the retaining means of the invention.

FIG. 17 is a bottom view of a retaining ring for use with a chair having five legs.

FIG. 18 is a bottom view of two covers secured to the retaining ring.

DESCRIPTION OF THE PREFERRED EMBODIMENTS

Figure 6:
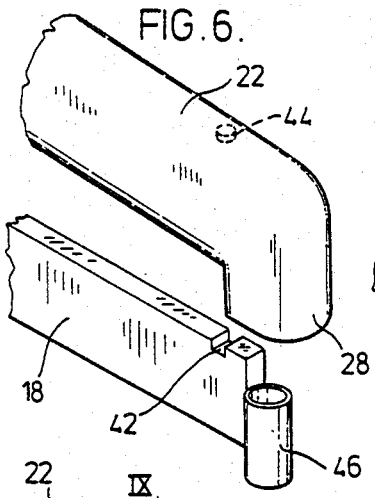
FIG. 6 is an exploded view of an end of a leg and cover showing one embodiment of the securing means of the invention.

Reference is first made to FIG. 1 which shows a perspective view of a chair base generally indicated as 10. The chair base 10 usually comprises a central column 12 from which extends a threaded column 14 with a handbell 16 secured thereto. A plurality of radially extending legs 18 extend from column 12 to which are affixed casters 20 by any well known means. It is to be understood that the specific construction of the chair base 10 forms no part of the present invention and is provided as only one example of such a construction.

The cover 22 of this invention is adpated to fit over and cover leg 18 and be secured thereto. The cover comprises an elongated cover portion 24 and one end portion 26 adapted to mate with the column 12 and another and opposite end portion 28 adapted to fit over the end of the leg 18.

Referring now to FIG. 2, there is shown a sectional view along line II—II of FIG. 1. This figure shows one possible configuration of cover 22. As shown in FIG. 2, cover 22 extends completely around and encases leg 18. Spacing means 30 extends downwardly and contacts the top surface of leg 18. Spacing means 30 runs the length of the inside of the cover 22 and is used to maintain cover 22 in a spaced relationship to the top surface of leg 18. This construction prevents damage to cover 22 in that the force or pressure applied to the top of the cover 22 should the user place his or her foot thereon, is spread along a greater portion of the cover 22 than the point of contact between the foot and the cover 22. Also, spacing means 30 helps to prevent damage to the cover which may be caused by the corners of the rectangular leg 18.

Cover 22 extends convexly downwardly around leg 18 and has a pair of identical retaining means 32 which are adapted to be releasably secured to the lower edge of leg 18. These retaining means 32 preferably are a pair of flanges 34 turned upwardly and inwardly and which are adpated to be releasably secured to leg 18. These flanges 34 are preferably biased inwardly to maintain contact against leg 18 and have a seat or notch 36 cut into the enlarged end 38 which forms a seat for leg 18.

FIG. 3 shows a second embodiment of the cover 22. In this embodiment, the sides of the cover 22 are curved with a greater angle thus producing a more rounded appearance. Also, it is noted that spacing means 30 included a notched end portion 40 which seats on and grips the upper surface of leg 18 which prevents any play or movement therebetween. The retaining means 32 of this embodiment shows shorter flanges 34 to releasably secure the cover 22 to the leg 18.

FIG. 4 shows a third embodiment of the cover 22. In this embodiment, retaining means 32 are identical to the embodiment as shown in FIG. 2. However, the spacing means 30 has been thickened and is of greater width than the leg 18. This embodiment provides greater strength to the unit when pressure is applied to the top of the cover 22 by a foot of the user of the chair. This spacing means 30 also has notched end portion 40 which grips the upper surface of the leg 18.

FIG. 5 shows a fourth embodiment wherein the retaining means 32 is identical to that shown in FIG. 3 and the height of the spacing means 30 has been lengthened.

Thus, it is seen from the foregoing embodiments that the cover 22 may be designed to fit a variety of legs and may be of varying shapes. The profiles of the covers 22 may be altered as shown in FIGS. 2 to 5 within the present invention to suit an individual user's tastes.

Reference is now made to FIGS. 4 to 12 which show various alternate embodiments for securing the end of the cover 22 to the end of the chair leg. It is pointed out that these embodiments may be used interchangeably with the various embodiments shown in FIGS. 2 to 5 in any desired combination.

Figure 7:
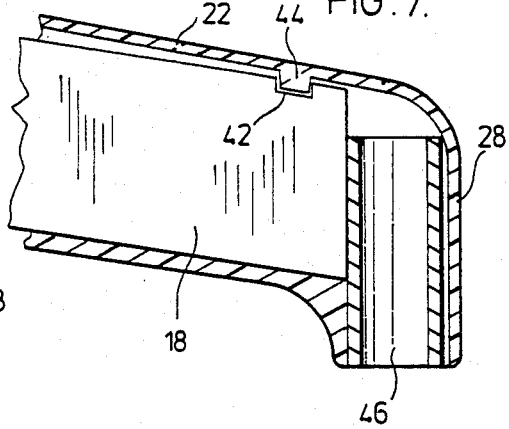
FIG. 7 is a side sectional view of FIG. 6.

Referring first to FIG. 6, the cover 22 has an end portion 28 which fits over the end of the leg 18. In this embodiment, a small notch 42 is cut in the top surface of the leg 18 and a corresponding protrusion 44 is secured to the inside upper surface of cover 22. Thus, as shown in FIG. 7, when the cover 22 is placed over the leg 18, the protrusion 44 seats in the notch 42 thus retaining the cover in place with respect to movement in the longitudinal direction. This structure is equally applicable when there is a separate caster socket 46 into which caster 20 is secured as shown in FIGS. 6 to 12 or if the caster socket is contained in the leg itself as shown in FIG. 1.

Figure 8:
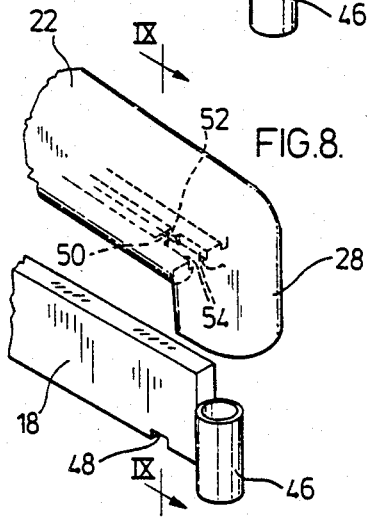
FIG. 8 is an exploded view of an end of a leg and cover showing a second embodiment of the securing means of the invention.
Figure 9:
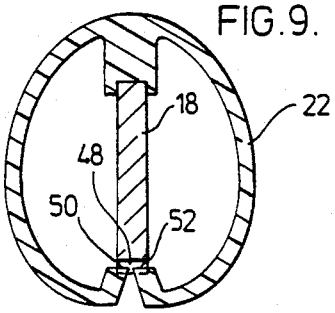
FIG. 9 is a sectional view along line IX—IX of FIG. 8.

A second embodiment is shown in FIGS. 8 and 9 wherein a notch 48 is cut in the undersurface of the leg 18. With this embodiment, a pair of protrusions 50,52 are provided on the inside surface 54 of the seat 36. These protrusions 50,52 seat themselves in notch 48 as shown in FIG. 9 which also prevents longitudinal movement of the assembled device.

Figure 10:
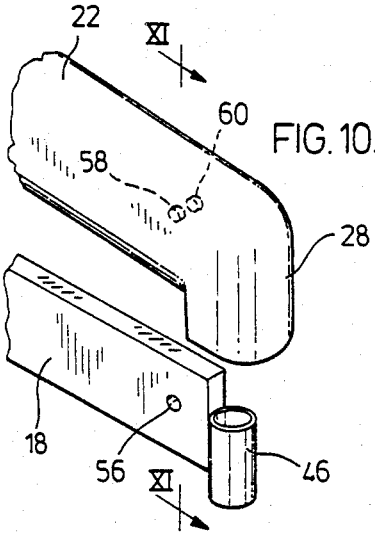
FIG. 10 is an exploded view of an end of a leg and cover showing a third embodiment of the securing means of the invention.
Figure 11:
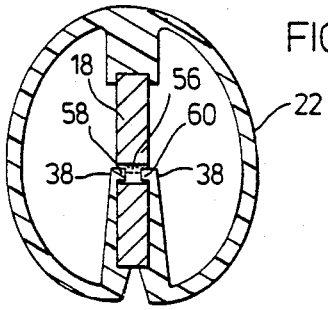
FIG. 11 is a sectional view along line XI—XI of FIG. 10.

A further embodiment is shown in FIGS. 10 and 11 wherein a notch 56 is cut into the sides of the leg 18. In this embodiment, the ends 38 have a pair of inwardly extending protrusions 58,60 which seat themselves in notch 56 as shown in FIG. 11. Again, this prevents longitudinal movement of the assembled device.

Figure 13:
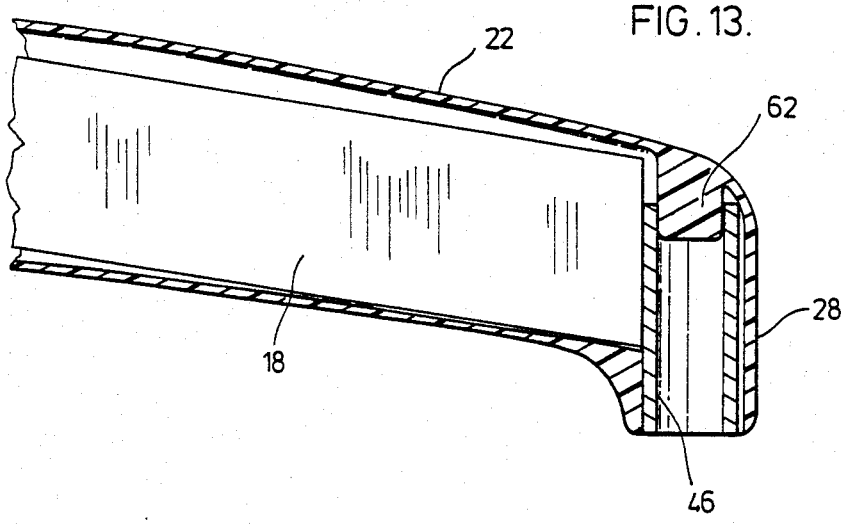
FIG. 13 is a side sectional view of the embodiment of FIG. 12.
Figure 12:
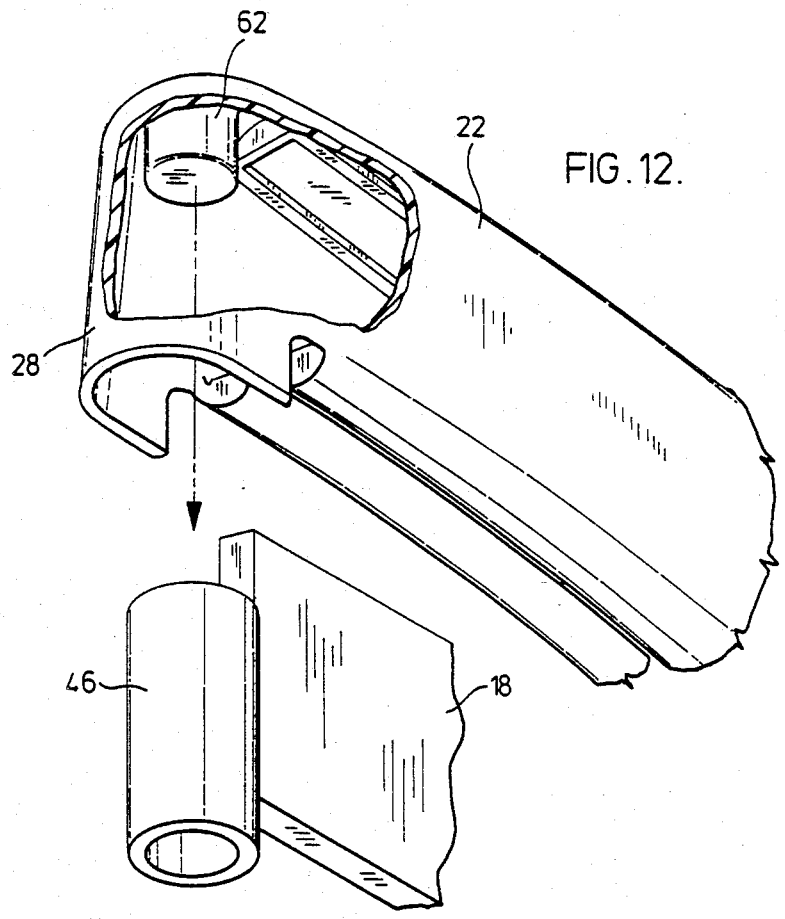
FIG. 12 is an exploded, partially cut-away view of the end of a leg and cover showing a further embodiment of the securing means of the invention.
Figure 14:
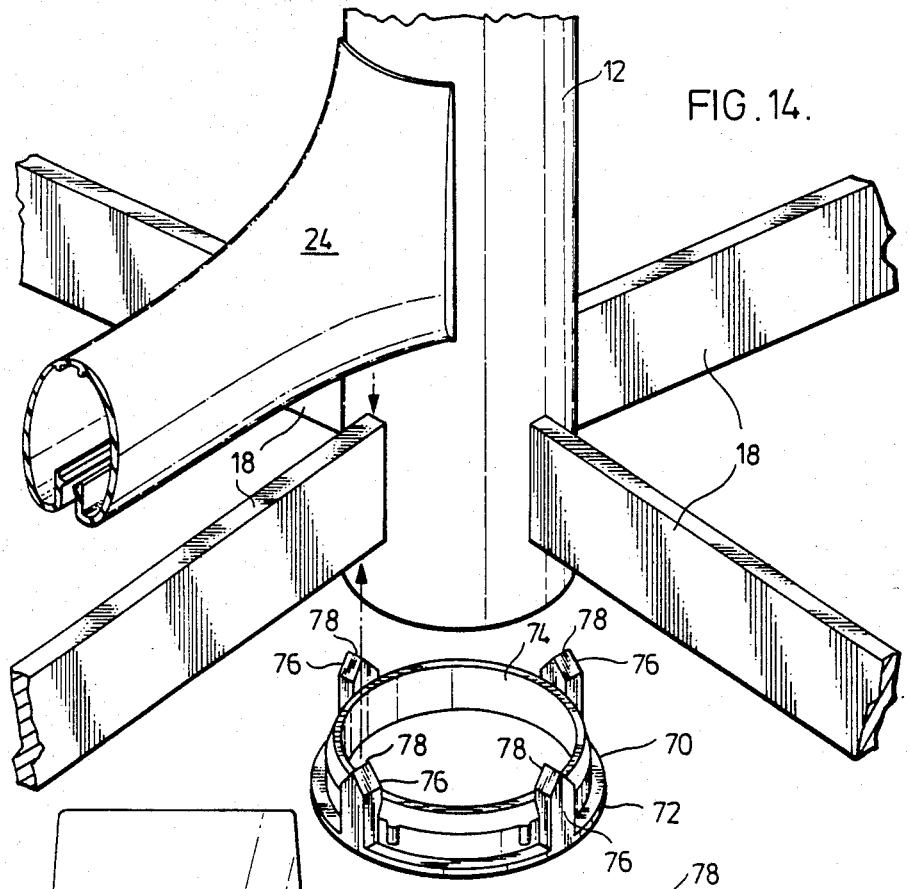
FIG. 14 is an exploded view showing the manner of affixation of the retaining ring.

A yet further embodiment is shown in FIGS. 12 and 13 which is suitable for use with legs which have a separate caster socket 46 affixed to the end of the leg 18. In this embodiment, a protrusion 62 is provided on the undersurface of the cover 22 at the end portion 28, which protrusion corresponds in shape and size to the caster socket 46. Thus, when the cover 22 fits over the leg 18, the protrusion 62 is seated in the caster socket 46 thus securing the cover 22 in place.

The outer shape of the cover 22 may be of any desired shape. As best shown in section, FIG. 2 illustrates an embodiment with relatively elliptical or concave sides. FIG. 3 illustrates another embodiment when the profile of cover 22 is more rounded or substantially circular. The profile of the cover may also be rectangular with relatively squared corners, if desired.

It is seen that the cover 22 of the present invention represents a substantial advance in the art. It may be manufactured of any suitable material such as a plastic material and may be coloured with any suitable colouring material. Thus, it is not necessary to colour the legs of a chair upon manufacture to suit the customer's desires. One only needs to affix the suitable coloured cover to a stock base and a variety of customer specification may be easily met.

The operation and installation of the cover 22 will now be explained with particular reference to FIGS. 1, 2, 6 and 7. It is also understood that the operation and installation is identical for all the embodiments shown in the drawings.

The cover 22 may be easily installed and affixed to the leg of the chair and is removed therefrom, without the use of any tools. For installing, the user merely spreads the flanges 34 and snaps the cover over the leg. End portion 26 is then mated with the column 12 in a contiguous manner and the opposite end portion 28 is mounted over the free end of the leg 18. When the end 28 is mounted over the free end of the leg, the securing means holds the cover 22 in place. As shown in FIGS. 6 and 7, protrusion 44 seats in notch 42.

Once assembled, the cover provides a neat appearance for all the legs. As shown in FIG. 1, end portion 26 of each cover mates with column 12 and forms a continuous and aesthietically pleasing cover over the lower part of the column 12. The cover 22 is held securely in place. Because of the unique design of the spacing means, the cover will not break or become damaged if the user places his foot on the cover. The action of the retaining means prevents the cover from being easily removed and the securing means prevents movement in either longitudinal direction.

When the cover is to be removed or replaced, the user merely places his fingers on the underside of the cover and spreads the flanges 34. Once the flanges 34 are spread, the cover is lifted upwardly and easily removed from the leg.

The cover also provides a further advantage. If the cover becomes damaged in any manner, or if the user wishes to change its colour, it is a rather easy task to simply remove the cover in place and replace it with another cover. Covers of different colours and shapes can be easily maintained in stock by the manufacturer and it is a relatively simple matter to replace the cover.

A direct result from the use of the cover of this invention is that the cost of manufacture and assembly of the chair has been significantly reduced. By using the cover, it is now possible to sell and distribute chairs wherein the legs are in a rough or unfinished condition. One of the principle costs of manufacturing such chairs is the cost of finishing the legs. It they are of wood, the wood must be stained, polished and of first grade; if they are of metal, the metal must be polished, coloured or finished perfectly. Any defect in the finishing of the legs has resulted in the return of the entire chair. With the cover, the manufacture is now able to sell a chair with the legs in an unfinished or rough condition and achieve the finished or polished look by affixing a cover to each of the legs. The cost of manufacturing the covers is much less than the cost of finishing the legs.

In a preferred embodiment of the invention, the inventor uses a retaining ring to retain the second ends of the covers in place. As stated hereinbefore, the end portion 26 of the cover 24 is mated with column 12 in a contiguous manner. In some cases, it has been found that the end portion 26 of the cover 24 may slip downward on column 12 particularly if the user has a habit of placing his or her feet on the top of the cover 24 and applying downward pressure thereto.

It is therefore preferred to use a retaining ring to retain the end portion 26 of all of the covers 24 in the desired position. While not essential, the use of the retaining ring ensures a clean and secure fit of all of the covers on the column 12.

The retaining ring 70 comprises a ring portion 72, a skirt portion 74 and spreader means 76. The number of spreader means 76 on each ring 70 is equal to the number of legs 18 on the chairs. Thus, if the chair has four legs, the ring 70 has four spreader means 76. If the chair carries five legs, the ring 70 has five spreader means 76. The spreader means 76 are equidistantly spaced about the outer peripheral surface of the skirt portion 74 and terminates in a ridge 78.

Figure 16:
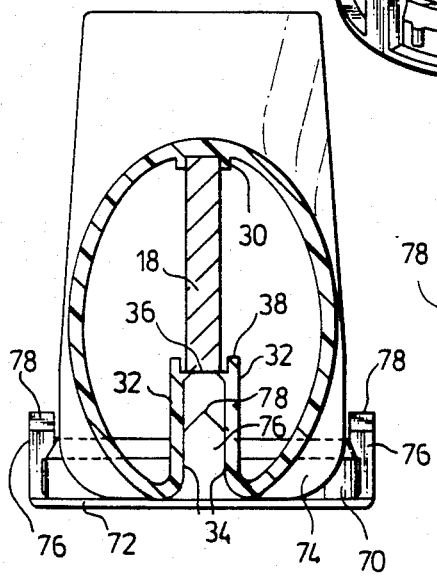
FIG. 16 is a sectional view showing the retaining ring and one cover held in place on a leg of a chair.

Referring now to FIGS. 14 to 18, the use and application of the retaining ring 70 will now be explained. FIG. 16 shows a cover portion of FIG. 4 inserted on the leg 18. The retaining means 70 is placed upside down such that the ring portion 72 is at the bottom and the skirt portion 74 and spreader means 76 extend upward. The ridge 78 of the spreader means 76 is then pushed and inserted between the flanges 34 and spreads them apart as shown in FIG. 16. The width of the spreader means 76 is such that the seat or notch 36 still forms a seat for leg 18.

Figure 15:
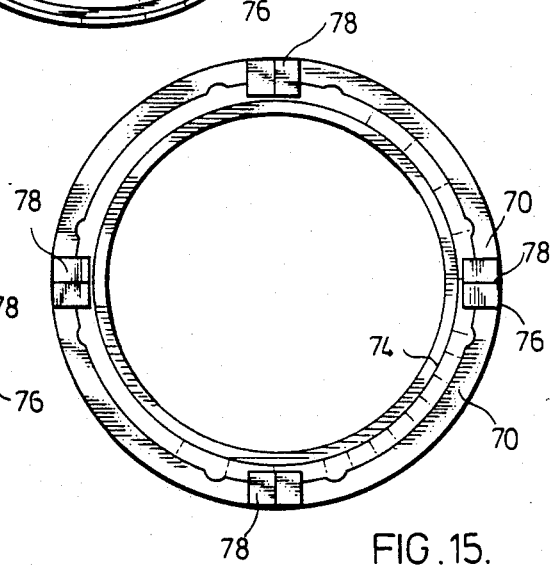
FIG. 15 is a bottom view of a retaining ring for use with a chair having four legs.

By using the retaining ring 70 as shown in FIG. 15, this has the net effect of forcing the ends 26 of each cover outwardly. Since the ends 26, in the non-stressed position are continuous with each other in the assembled position, by inserting the retaining ring 70, this applies increased outward pressure on the contiguous edges 80 of each of the cover portions (see FIG. 18) thereby securing and retaining the cover portions in the desired positions. In the event that the user constantly applies downward pressure by resting or place his foot on the cover, this increased outward pressure will prevent damage to the system.

The retaining ring may be made of any suitable material. Particularly preferred embodiments include plastics such as polypropylene, aluminum or polyamides such as NYLON (registered trade mark).

Although the disclosure describes and illustrates a preferred embodiment of the invention, it is to be understood the invention is not restricted to this particular embodiment.

What I claim is:

1. A covering means adapted to cover and be retained on legs of a chair, said covering means comprising a plurality of covers, each cover comprising a cover portion adapted to surround and cover a leg, said cover portion having a top inner surface, a first end portion adapted to cover the free end of the leg, a second end portion adapted to cover the opposite end of the leg, spacing means adapted to space said cover portion from the top surface of said leg, retaining means adapted to releasably retain said cover to said leg, and a retaining ring adapted to retain the second ends of all of the covers in the desired position.

2. A covering means as claimed in claim 1 wherein said retaining ring comprises a ring portion, a skirt portion and a plurality of spreader means, each spreader means adapted to be inserted into said retaining means and to retain said cover in the desired position.

3. A covering means as claimed in claim 2 wherein said retaining means is made of aluminum.

4. A covering means as claimed in claim 2 wherein said retaining means is made of polyamides.

5. A covering means as claimed in claim 1 wherein said spacing means is a longitudinal protrusion protruding inwardly from the top inner surface of said cover and adapted to rest on the top surface of said leg.

6. A covering means as claimed in claim 1 wherein said first end portion is adapted to cover and extend marginally below the free end of said leg.

7. A covering means as claimed in claim 1 wherein said retaining means comprises a pair of upturned and inwardly biased flanges adapted to be releasably secured to lower surfaces of said leg.

8. A covering means as claimed in claim 7 wherein said flanges carry a seat portion which is adapted to receive and retain the bottom of the leg therein.

9. A covering means as claimed in claim 1 wherein said spacing means is a longitudinal protrusion protruding inwardly from the top inner surface of said cover, said protrusion adapted to surround and retain the top surface of said leg and said protrusion.

10. A covering means as claimed in claim 1 further including a securing means adapted to releasably secure the first end of each cover to the free end of each leg.

11. A covering means as claimed in claim 10 wherein said securing means comprises a protrusion extending downwardly from the top inner surface of the first end portion of said cover and adapted to seat in corresponding notch in the top surface of said leg.

12. A covering means as claimed in claim 10 wherein said securing means comprises a pair of protrusion extending inwardly from the retaining means, said protrusions adapted to seat in a corresponding notch in the bottom surface of said leg.

13. A covering means as claimed in claim 10 wherein said securing means comprises a pair of protrusions extending inwardly from the respective sides of the first end portion of the cover and adapted to seat in a corresponding notch in the sides of said leg.

14. A covering means as claimed in claim 10 wherein said securing means comprises a protrusion extending downwardly from the inner surface of said first end portion of said cover and adapted to seat in a caster socket on the terminal portion of the leg of the chair.

15. A covering means as claimed in claim 1 wherein each cover is substantially elliptical in section.

16. A covering means as claimed in claim 1 wherein each cover is substantially circular in shape.

17. A covering means as claimed in claim 1 wherein each cover is retangular in section.

18. A covering means as claimed in claim 1 (which) wherein each cover is made of a plastic material.

19. A covering means as claimed in claim 18 wherein said plastic is coloured.

20. A covering means adapted to cover and be retained on legs of a chair, said covering means comprising a plurality of covers, each cover adapted to cover a leg of a chair, said leg extending outwardly from a central column and terminating in a free end, said cover comprising a cover portiion adapted to surround and cover said leg, said cover portion having a top inner surface, a first end portion adapted to cover the free end of said leg, a second end portion adapted to meet with said central column, spacing means adapted to space said cover portion from the top surface of said leg, retaining means adapted to releasably retain said cover to said leg, and a retaining ring adapted to retain the second ends of all of the covers in the desired position.

21. A covering means as claimed in claim 20 wherein said spacing means is a longitudinal protrusion protruding inwardly from the top inner surface of said cover and adapted to rest on the top surface of said leg.

22. A covering means as claimed in claim 20 wherein said first end portion is adapted to cover and extend marginally below the free end of said leg.

23. A covering means as claimed in claim 20 wherein said retaining means comprises a pair of upturned and inwardly biased flanges adapted to be releasably secured to the lower surfaces of said leg.

24. A covering means as claimed in claim 23 wherein said flanges carry a seat portion which is adapted to receive and retain the bottom of said leg therein.

25. A covering means as claimed in claim 20 wherein said spacing means is a longitudinal protrusion protruding inwardly from the top inner surface of said cover, said protrusion adapted to surround and retain the top surface of said leg and said protrusion.

26. A covering means as claimed in claim 20 further including a securing means adapted to releasably secure the first end portion of the cover to the free end of the leg.

27. A covering means as claimed in claim 20 wherein said cover is substantially elliptical in section.

28. A covering means as claimed in claim 20 wherein said cover is substantially circular in section.

29. A covering means as claimed in claim 20 wherein said cover is rectangular in section.

30. A covering means as claimed in claim 20 wherein each cover is made of a plastic material.

31. A covering means as claimed in claim 30 wherein said plastic is coloured.

32. A covering means adapted to cover and be retained on legs of a chair, said covering means comprising a plurality of covers, each cover comprising a plastic cover adapted to cover a leg of a chair, said leg extending outwardly from a central column and terminating in a free end, said cover comprising:

a cover portion adapted to surround and cover said leg, said cover portion having a top inner surface;

a first end portion adapted to cover the free end of said leg and to extend marginally below the free end of said leg;

a second end portion adapted to meet with said central column;

a longitudinal protrusion protruding inwardly from the top inner surface of said cover and adapted to seat on the top surface of said leg thereby spacing said cover portion from the top surface of said leg;

retaining means adapted to releasably retain said cover to said leg, said retaining means comprising a pair of upturned and inwardly biased flanges adapted to be releasably secured to the lower surfaces of said legs, said flanges carrying a seat portion which is adapted to receive and retain the bottom of said leg therein;

and a retaining ring adapted to retain the second ends of all of the covers in the desired position.

33. A covering means as claimed in claim 32 wherein said retaining means is made of aluminum.

34. A covering means as claimed in claim 32 wherein said retaining means is made of polyamides.

35. A covering means as claimed in claim 32 wherein said retaining ring comprises a ring portion, a skirt portion and a plurality of spreader means, each spreader means adapted to be inserted between said flanges and to bias said flanges outwardly.

36. A covering means as claimed in claim 35 wherein said retaining means is made of aluminum.

37. A covering means as claimed in claim 35 wherein said retaining means is made of polyamides.

38. A covering means as claimed in claim 20 wherein said retaining ring comprises a ring portion, a skirt portion and a plurality of spreader means, each spreader means, adapted to be inserted into said retaining means and to retain said cover in the desired position.

* * * * *